US005397620A

United States Patent [19]

Hord, III

[11] Patent Number: 5,397,620

[45] Date of Patent: Mar. 14, 1995

[54] SYSTEM AND METHOD FOR FORMING ACTIVITY SURFACE

[75] Inventor: R. Anderson Hord, III, Charlottesville, Va.

[73] Assignee: Thomas D. Root, Charlottesville, Va.

[21] Appl. No.: 42,740

[22] Filed: Apr. 5, 1993

[51] Int. Cl.[6] ..... B32B 5/16

[52] U.S. Cl. ..... 428/142; 428/143; 428/147; 428/327; 428/493

[58] Field of Search ..... 428/327, 147, 143, 142, 428/493; 427/138, 139, 202, 203; 404/31, 32, 82

[56] References Cited

U.S. PATENT DOCUMENTS

| | | | |
|---|---|---|---|
| 2,925,831 | 2/1960 | Welty et al. | 138/80 |
| 3,446,122 | 5/1969 | Raichle et al. | 94/7 |
| 3,993,412 | 11/1976 | Drane | 404/28 |
| 4,082,888 | 4/1978 | Portin | 428/327 |
| 4,341,836 | 7/1982 | Becker | 428/308.4 |
| 4,420,513 | 12/1983 | Coke et al. | 427/407.1 |
| 4,474,833 | 10/1984 | Maxfield | 427/138 |
| 4,529,622 | 7/1985 | Maxfield | 427/136 |
| 4,557,475 | 12/1985 | Donovan | 273/3 |
| 4,564,310 | 1/1986 | Thelen et al. | 404/31 |
| 4,614,686 | 9/1986 | Coke et al. | 428/327 |
| 4,800,119 | 1/1989 | Kolar | 428/283 |
| 5,182,137 | 1/1993 | Allen | 427/108 |

*Primary Examiner*—D. S. Nakarani
*Assistant Examiner*—H. Thi Le
*Attorney, Agent, or Firm*—Peter E. Rosden

[57] ABSTRACT

A structure and related method for forming a surface on which sports activities occur. The disclosed structure uses three basic layers to form the surface on top of a prepared substrate. The first layer is comprised of a plurality of sublayers bound together by adhesive coatings, the first of which requires deposition of resilient particles in the 3 to 6 millimeter size range. Several subsequent sublayers include smaller-sized particles which, after deposition and spreading, result in a relatively smooth and resilient latex-bound base mat. The second layer provides a cushion coating, while a slightly textured decorative finish coating results from application of the third and final top layer. A method for forming these three layers is also disclosed which method specifies both the sizes of particles and the spread rate for particles and adhesive material for each of the sublayers in the first layer. The disclosed surface is particularly durable and provides a playing area for sports activities that is more impact-absorbing than other similar artificial sports surfaces.

9 Claims, 1 Drawing Sheet

SYSTEM AND METHOD FOR FORMING ACTIVITY SURFACE

TECHNICAL FIELD

The subject invention generally relates to the formation of a playing surface for sports activities, such as tennis, and, more particularly, to a system and method for building such a surface which has significant health benefits for sports participants. The invention accomplishes this goal at a reasonable cost, is environmentally valuable through the use of recycled rubber materials, and its execution results in a particularly durable and comfortable playing surface.

BACKGROUND OF THE INVENTION

The construction of artificial playing surfaces for sporting activities has been undertaken using many different types of materials and methods. Coatings of rubber, plastic and polyurethane have been applied on top of substrates, such as asphalt, concrete or wood to achieve playing surfaces. Although these artificial surfaces do generally have the advantage of durability, they also suffer from various disadvantages, including, in various cases, high installation cost, limitations on use due to climatic factors and physical discomfort due to hardness. Moreover, even when materials are chosen to overcome some of these problems, their method of installation can leave other problems unsolved, as well as create new, otherwise unforeseen problems. For example, rubberized surfaces can ameliorate the hardness problem, but are prohibitively expensive. Also, if the rubber material is applied wet and allowed to cure in open air, the length of time needed for drying results in a surface which is often simply not smooth enough for satisfactory use in many sports, such as for playing tennis. On the other hand, latex surfaces dry more quickly and have the added benefit of substantially eliminating the possibility that toxic substances, such as accompany the use of polyurethanes, would leach into surrounding ground areas. A combination of rubberized materials with a latex-based installation method would appear to best solve these problems so as to achieve a satisfactory surface.

Added and growing problems which have not yet been solved, let alone addressed, by existing artificial all-weather playing surfaces involve the special requirements of an aging, yet active, population interested in continuing their sporting activities. Many playing surfaces fail to sufficiently slow the speed of a bouncing ball, in some cases limiting the ability of older sports enthusiasts to enjoy and participate in activities played thereon. Also, the harder the artificial surface is, the more jarring each impact while running can be on a user's knees, joints and feet. The likelihood of injuries, especially for the older user, is thereby increased. This is not only an unpleasant consequence for the sporting activist, it also increases the exposure of the surface owner to legal liability and concomitantly raises the cost of any liability insurance which the owner purchases.

One effort to solve some of these problems is typified by the patent to Becker (U.S. Pat. No. 4,341,836) in which a surface for playing tennis is constructed by dry-spreading fine grains of rubber particulate over rubber fragments embedded in a bearing layer to cover voids left between the rubber fragments. Although this surface was advantageously designed to be less rigid and to allow a tennis player to slide to a stop when moving, since the rubber particulate is not bound together, the surface is not an all-weather surface and can even lead to excessive slippage under certain conditions. Furthermore, its installation requires the use of rather expensive spraying equipment. The surface of the present invention, by contrast, advantageously provides at low cost a somewhat flexible playing surface, while retaining all-weather playing characteristics.

SUMMARY OF THE INVENTION

The present invention is a structure and related method for forming a surface on which sports activities occur. The disclosed structure combines three basic layers to form the surface on top of a prepared substrate. The first layer is comprised of a plurality of sublayers of resilient particles bound together by latex-based adhesive coatings. The first sublayer requires deposition and spreading of resilient particles in the 3 to 6 millimeter size range on top of an adhesive coating previously applied to a substrate. Several subsequent sublayers include smaller-sized particles which, after deposition and spreading, gradually fill in the spaces and valleys left between the particles deposited in the first sublayer. An adhesive coating is applied between each sublayer both for binding the particles within each layer together and for creating a good bonding base for application of adhesive coatings in subsequent sublayers. After the application of several such sublayers a smooth and resilient latex-bound base mat is created. The second layer provides a cushion coating, while a decorative finish coating results from application of the third and final top layer.

A method for forming these three layers is also disclosed. In the first layer, the method specifies both the sizes of particles and the spread rate for particles and adhesive material for each of the required sublayers. Both the size and spread rate of particles used in each successive sublayer in the first layer are reduced in stages. In the preferred form of the invention, five sublayers of rubber particles are used in the first layer. The first sublayer comprises rubber particles in the 3 to 6 millimeter size range applied at a rate of 2.5 pounds per square yard which is then covered by a latex binder applied at the rate of 0.15 gallons per square yard. The second sublayer comprises rubber particles in the 1 to 3 millimeter size range applied at a rate of 2.4 pounds per square yard followed by an application of the latex binder applied at a rate of 0.18 gallons per square yard. The third, fourth and fifth sublayers are each comprised of rubber particles in the 0.5 to 1.5 millimeter size range which are applied, respectively, at rates of 2, 1.2 and 1 pounds per square yard. The adhesive coatings used after each of these sublayers are applied, respectively, at rates of 0.15, 0.12 and 0.1 gallons per square yard. The second layer provides a cushion coating applied at a rate of 0.3 gallons per square yard, while a multi-coat decorative finish results from application of the third and final top layer.

It is a primary objective of this invention to provide an artificial sports surface which is smooth and durable, while still being economical to install.

A further objective of this invention is to provide such a surface which is also resilient enough to substantially reduce the impact and resultant shock felt while moving around on the surface, thereby minimizing the risk of injury to its users.

An additional objective of this invention is to provide an environmentally beneficial activity surface through the use of recycled material which is sealed in a latex coating so as to substantially eliminate the risk of emitting toxic substances.

Yet another objective of this invention is to provide a sports surface which is resistant to cracking.

A still further objective of this invention is to provide a surface upon which balls bounce slightly slower than on other artificial surfaces so as to enhance its attractiveness to a broad spectrum of older persons.

BRIEF DESCRIPTION OF THE DRAWINGS

The foregoing and other objects, aspects and advantages of the invention will be better understood from the following detailed description of the invention with reference to the drawing, in which.

DESCRIPTION OF THE PREFERRED EMBODIMENT

Figure 1:
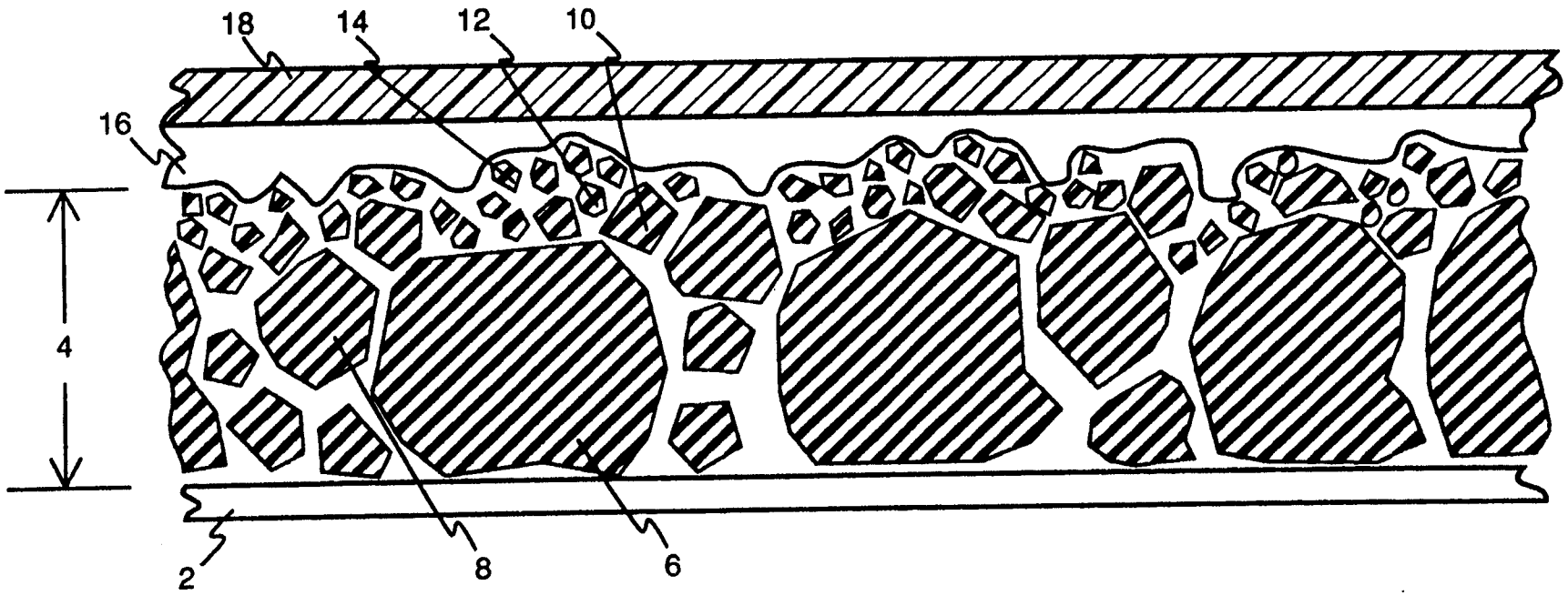
FIGURE 1 is a cross-sectional view of the surface of the preferred embodiment of the invention.

For a more detailed understanding of the invention, reference is made to FIGURE 1 of the drawings. This figure illustrates a cross-sectional view of a surface formed according to the system and method of the instant invention. The focus of the invention is a system for creating a three-layer, artificial activity surface, suitable for tennis, volleyball and other sporting activities. The system is constructed on top of a substrate 2. In the preferred embodiment, this substrate is made from asphalt. However, other bases having suitable planarity and slope, such as concrete, may also be used. The three layers are constructed in a three-phase process.

The first phase consists of constructing a latex-bound rubber base mat 4 having a thickness of not less than $\frac{1}{4}$ inch and preferably $\frac{3}{8}$ inch to $\frac{1}{2}$ inch. The mat is comprised of multiple sublayers of smaller resilient particles deposited on top of an initial sublayer of relatively larger resilient particles. In the preferred embodiment, the resilient particles are irregular pieces of vulcanized rubber, such as SBR or EPDM, known to those in the trade, which is derived by reclaiming from vehicle tires and industrial scrap. The various sublayers are bound together with a latex binder, as explained below.

The method of application and binding of the various sublayers of particles contributes to the success of the structure of the invention. Basically, two general types of application for each sublayer are available, a wet method and a dry method. In the wet method, disclosed in the patent to Portin (U.S. Pat. No. 4,082,888), rubber particles are mixed with a latex binder and the resultant mixture is hand-troweled into place. In a variation of this method, the resultant mixture is applied by spraying, using an air compressor. Although the wet method has certain advantages, for purposes of the preferred embodiment of this invention, use of the wet method is disadvantageous since it requires a long period of time for any sublayer applied with this method to cure by exposure to air. As a result, total installation time is extended. Furthermore, any individual surface resulting from use of the the wet method is difficult to control, lessening the likelihood of obtaining a smooth enough surface to achieve the objectives of this invention. By contrast, in the dry method, typified by the patents to Maxfield (U.S. Pat. Nos. 4,474,833 and 4,529,622), rubber particles are dry-spread onto a surface and saturated with a latex binder. Note, however, that the structure disclosed in the Maxfield patents is not suitable for tennis, as is the structure of the instant invention. This procedure is repeated until the desired thickness is achieved. This general application method, when used in conjunction with the multiple sublayer structure using the sizes of rubber particles and rates of application discussed below, permits this invention to overcome the deficiencies of the wet method and provides a faster curing, smoother and more structured surface than previously available.

In this invention, substrate 2 is prepared for the initial phase by cleaning. Then, an initial tack coat of a latex binder is applied at a rate of approximately 0.5 gallons per square yard to substrate 2 which is allowed to dry to the touch. The adhesive coating material is preferably a carboxylated styrene butadiene latex emulsion such as 76 RES 4125 having a solid content of 50 wt %, sold under the trademark [76 RES 4125] owned by Rohm and Haas, which is diluted with water at a rate of up to one gallon of water to one gallon of adhesive. The same adhesive coating material is used for the application of each sublayer, although different materials can be substituted to achieve a similar result.

Next, a first sublayer of rubber particulate 6, preferably 3 millimeters to 6 millimeters in size, is applied at a rate of approximately 2.5 pounds per square yard. The particulate is dry-spread onto the tack coat by raking with a lute or by mechanically metering the dry rubber onto the surface using a top dressing distributor, such as that sold under the trademark [METE-R-MATIC TOP DRESSER] owned by Turfco Manufacturing, Inc., or other metering device. Subsequent sublayers of particulate are similarly applied. The newly applied particulate is then saturated by spraying with a latex binder, as described above, at a rate of approximately 0.15 gallons per square yard.

After this sublayer has dried, a second sublayer of rubber particulate 8, preferably 1 millimeter to 3 millimeters in size, is applied at a rate of approximately 2.6 pounds per square yard. The new sublayer of particulate is then saturated with latex binder, as described above, at a rate of approximately 0.18 gallons per square yard.

After this sublayer has dried, a third layer of rubber particulate 10, preferably 0.5 millimeter to 1.5 millimeters in size, is applied at a rate of approximately 2.0 pounds per square yard. The new sublayer of particulate is then saturated with latex binder, as described above, at a rate of approximately 0.15 gallons per square yard.

After this sublayer has dried, a fourth sublayer of rubber particulate 12, preferably 0.5 millimeter to 1.5 millimeters in size, is applied at a rate of approximately 1.2 pounds per square yard. The new sublayer of particulate is then saturated with latex binder, as described above, at a rate of approximately 0.12 gallons per square yard.

After this sublayer has dried, a fifth sublayer of rubber particulate 14, preferably 0.5 millimeter to 1.5 millimeters in size, is applied at a rate of approximately 1.0 pounds per square yard. The new sublayer of particulate is then saturated with latex binder, as described above, at a rate of approximately 0.10 gallons per square yard.

It is critical to the success of the invention that the first layer be constructed by application of multiple sublayers, as described above. By using a first sublayer of larger particles in the first layer, a stable base is created for the entire layer. Moreover, by choosing 3 to 6 millimeters as the size of the largest particles in the first sublayer, the overall thickness of the finished surface is mandated. A finished surface of approximately ⅜ inch thickness has been found to be the proper thickness to achieve the best combination of minimal cost, durability, smoothness and desirable impact absorption for purposes of this surface. The subsequent use of multiple layers of smaller particles, which decrease in size in phases, further enhances stability by permitting the mat to develop a solidity and density not previously available. The reduced size of the particles in successive sublayers fills in the voids created by deposition of larger particles in previous sublayers. Furthermore, by minimizing the distance between particles, as occurs through a phased reduction in particle size in subsequent sublayers, the cohesive effect of the latex binders used in this invention are enhanced, both between particles within the same sublayer and between sublayers. In addition, a more durable layer is produced since a higher percentage of the void space in the layer is filled with resilient particles which contact each other, rather than adhesive coating material which breaks down more quickly than such particles. Therefore, the mat resulting from application of these five sublayers of rubber particulate will be dense, durable and have a smooth texture.

The second phase consists of installing a second layer 16 of one or more applications of a cushion-coat emulsion product, such as that sold under the trademark [DECOTURF] owned by Koch Materials Company which is a rubber-filled latex coating compound or that sold under the trademark [PLEXICUSHION] owned by California Products Corporation which is a synthetic, shock-absorbing composition containing rubber particles. This type of cushion-coated material is well-known in the art. Although it can be applied by spraying, for purposes of this invention, it is preferable to apply it by squeegee at a rate of approximately 0.30 gallons per square yard. This method of application creates a very smooth and uniform coating so that the color film applied in the third phase, described below, will also be uniform and less likely to crack. Additional coatings may be desirable to achieve a still smoother texture. Such added coatings are applied after any previous coating has dried enough to walk on without leaving permanent deformities. A primary purpose of the second layer is to fill in any remaining voids left in the first layer, resulting in an extremely smooth surface having a uniform thickness which is particularly important to ensure durability of the third layer, discussed below.

The third phase consists of installing a third layer 18 of an acrylic or vinyl-acrylic color finish system, such as that sold under the trademark [DECOCOLOR] owned by Koch Materials Company which is an acrylic latex decorative coating or [PLEXIPAVE] owned by California Products Corporation, which is an acrylic latex color finishing system. A minimum of two applications are required in order to ensure uniformity. Whether an acrylic or vinyl-acrylic color finish system is used is a matter of user preference. The coatings are mixed and applied in accordance with manufacturer's recommendations. Successful application of this third layer and its durability depend upon the smoothness of the surface on which it is applied, i.e. the second layer, and upon achieving a uniform film thickness. If either of these requirements is not met, the acrylic coating will crack.

The resultant product is a resilient activity surface with a thickness of approximately ⅜ inch, particularly suitable for tennis, which absorbs significantly more impact than other latex-bound cushion systems. The system is significantly less expensive than polyurethane systems which have similar energy absorption characteristics. In addition, the system is environmentally safe to install and use and provides a physically safer and more comfortable surface due to its energy-absorbing characteristics. The system is also very inexpensive to maintain and to resurface. Resurfacing of the system, which may occur every five to ten years, is limited to the third phase of the system. Additionally, this system is more durable than other known systems since it resists cracking from stress due to the inherent smoothness of each of the layers. Finally, the system produces a surface texture, which, in a game such as tennis, will slow the speed of a bouncing ball and, thus, provides for a more enjoyable game for middle-age and older participants.

Those skilled in this art will understand after a review of the description provided above that substitutions of materials and modifications in the method of application to form the surface of the instant invention may be used to achieve the result of this invention so long as the concepts defined by the following claims are adhered to.

What is claimed is:

1. A multi-layered surface on which the sports of tennis and volleyball are performed for installation on top of a prepared substrate, comprised of:

a first latex-bound base mat layer formed of a plurality of successively applied sublayers of rubber particles; each sublayer is covered by a carboxylated-styrene-butadiene adhesive coating before the next sublayer is applied, wherein sublayers of rubber particles applied after the first sublayer of rubber particles are comprised of rubber particles smaller in size than that used in a preceding sublayer and are applied at a decreasing spread rate, and wherein the first sublayer is comprised of rubber particles of between three millimeters and six millimeters in size;

a second cushion-coat layer; and a third finishing top layer further comprised of at least two coatings of a color finishing material.

2. The surface of claim 1, wherein said mat layer is comprised of five sublayers.

3. The surface of claim 2, wherein the second sublayer is comprised of rubber particles of between one millimeters and three millimeters in size.

4. The surface of claim 3, wherein the third sublayer is comprised of rubber particles of between one-half millimeter and one and one-half millimeters in size.

5. The surface of claim 4, wherein the fourth sublayer is comprised of rubber particles of between one-half millimeter and one and one-half millimeters in size.

6. The surface of claim 5, wherein the fifth sublayer is comprised of rubber particles of between one-half millimeter and one and one-half millimeters in size.

7. The surface of claim 1, wherein said cushion-coat layer is comprised of at least one coating of a cushion-coat emulsion product.

8. The surface of claim 1, wherein the color finishing material used for the finishing top layer is an acrylic.

9. The surface of claim 1, wherein the color finishing material used for the finishing top layer is a vinyl-acrylic.

* * * * *